United States Patent [19]

Mollica

[11] 4,259,996

[45] Apr. 7, 1981

[54] SHUTTLELESS LOOM

[76] Inventor: Francesco Mollica, Via Staurenghi, 31-Varese, Italy

[21] Appl. No.: 53,455

[22] Filed: Jun. 29, 1979

[51] Int. Cl.[3] ..... D03D 47/24

[52] U.S. Cl. ..... 139/437

[58] Field of Search ..... 139/437, 438, 439

[56] References Cited

U.S. PATENT DOCUMENTS

| | | | |
|---|---|---|---|
| 3,388,722 | 6/1968 | Sakamoto | 139/437 |
| 3,444,902 | 5/1969 | Moessinger | 139/437 |
| 4,015,642 | 4/1977 | Mollica | 139/439 |
| 4,098,300 | 7/1978 | Mollica | 139/439 |

*Primary Examiner*—Henry Jaudon

*Attorney, Agent, or Firm*—Guido Modiano; Albert Josif

[57] ABSTRACT

A shuttleless loom comprises a weft thread carrier throwing device and a recovering device, and provides for a substantial halting of each of the weft thread carriers prior to the throwing thereof. The throwing device includes a rotary member set for substantially continuous rotation and cooperating with a fixed casing to define an open throwing track for the weft thread carriers. An accumulator chamber is located substantially adjacent to the inlet end of the weft thread carrier throwing device and is operative to temporarily withhold each weft thread carrier supplied by the recovering device. A feeder is located substantially between the accumulator chamber and the open throwing track and is operative to insert the weft thread carriers one by one from the chamber into the track.

9 Claims, 9 Drawing Figures

9
14
15a
15
21
22
23
24
25
13"
10
8
8a
26
29
30
31
26a
26b
26c
27
27a
28
17"

SHUTTLELESS LOOM

BACKGROUND OF THE INVENTION

This invention relates to an improved shuttleless loom, in particular of the type which utilizes one or more weft thread carriers moving along a closed path.

As is known, shuttleless looms, also called shuttleless Sulzer looms, have important advantages over traditional looms of the shuttle type. In fact, since the thread-carrying cop no longer needs to be carried through the shed in the shuttle, it becomes possible to considerably reduce the size of the weft thread carriers and, accordingly, the moving masses involved, which results in an increase of the throw velocity and of the production output over traditional looms.

Also known is, however, that along with such advantages, shuttleless or Sulzer-type looms have some significant drawbacks.

First of all, they require energy in considerable amounts: both the weft thread carrier throwing and, above all, the cyclic actuation of the throwing members—the latter involving particularly high momenta—imply a waste of energy which remains for the most part unused because the weft thread carriers and throwing members have to be brought back to rest after each throw.

Another drawback, and one of great practical importance, is the noisy operation of such looms, as due primarily to the fast reciprocating masses, which are continuously subjected to sudden restarts and stops.

Previous studies by the same Inventor have substantially solved such problems. For example, U.S. Pat. No. 4,015,642 discloses a loom wherein a weft thread carrier is redirected as it emerges from the shed, i.e. after being passed through the warp threads, along a return travel guide which takes it back without discontinuities of motion over a continuous closed path, at the shed entering area, exactly to the starting point.

The solutions disclosed in the cited patent have resulted in a surprisingly advantageous loom as regards efficiency, silent operation, reduced energy expenditure, and above all operating speed. In other terms, a loom has been provided which affords a much higher performance level than the best of conventional shuttleless looms. However, the cost of the loom proved to be directly related to its performance, namely a high one, and, furthermore specially critical was the tuning of those members which provide for the synchronization of the weft thread carrier throws to the sley movements.

In actual practice, the synchronization of the weft thread carrier throws requires expensive and quite sophisticated control devices, which are indeed practicable, as the numerous tests carried out have proved, but are unsuitable for application to looms which are not intended for specially high performance.

Another problem, also connected with the solutions taught in the cited patent by this same Inventor, is that such a loom cannot result from an adaptation of prior or existing conventional shuttleless looms, since the latter are inadequate to provide the required performance level, and too many and important are the machine members in need of being modified and replaced.

Thus, it can be seen that the conventional art has a remarkably important disadvantage, namely, there are no looms available which, for one aspect, can overcome at least most of the serious drawbacks connected with said conventional shuttleless looms, which require a considerable expenditure of energy for the intermittent operation of their members, in particular of their throwing members, and are too noisy in operation, and for another aspect, are not particularly so very expensive and complicated to tune, many looms being not intended for particularly high performance levels.

In practice, the current state of the art provides for no possibility to update with simple and inexpensive operations the large number of old-type shuttleless looms present in the field, in agreement with modern requisites which forbid excessive energy consumption and noise emission.

SUMMARY OF THE INVENTION

This invention sets out to fill said want in the art, by providing a shuttleless loom which mostly eliminates the drawbacks mentioned above and lends itself to a more general utilization, even where no specially high performance is sought, and where as reduced investment and running expenses as possible are contemplated.

According to one aspect of this invention, there is provided an improved shuttleless loom comprising a weft thread carrier throwing device and a recovering device, and providing for a substantial halting of each of said weft thread carriers prior to the throwing thereof, the loom being characterized in that said throwing device includes a rotary member set for substantially continuous rotation and cooperating with a fixed casing to define an open throwing track for said weft thread carriers provided with an inlet and an outlet end open to the region of insertion through the loom shed, and further includes an accumulator chamber located substantially adjacent to said inlet end and operative to withold at least one weft thread carrier supplied by said recovering device, and a feeder located substantially between said accumulator chamber and said open throwing track and operative to insert said weft thread carriers one by one from said chamber into said track, said feeder being actuated such that each weft thread carrier is inserted into said open throwing track in advance with respect to the correct time for the insertion of said weft thread carrier through the loom shed by an amount dependent on the time period required to span said open throwing track.

BRIEF DESCRIPTION OF THE DRAWINGS

Further features and advantages will be more clearly apparent from the following description of preferred, though not restrictive, embodiments of this invention, illustrated by way of example only in the accompanying drawings, where.

DESCRIPTION OF THE PREFERRED EMBODIMENTS

Figure 2:
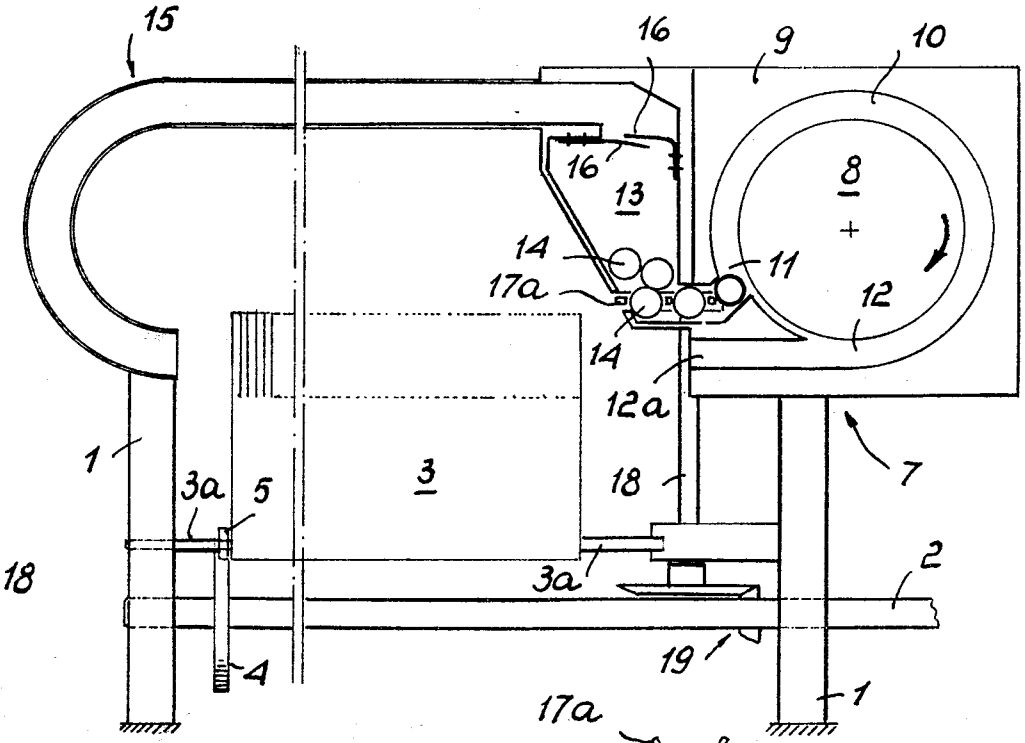
FIG. 2 is a schematical and partly sectional front view of the loom of FIG. 1.
Figure 1:
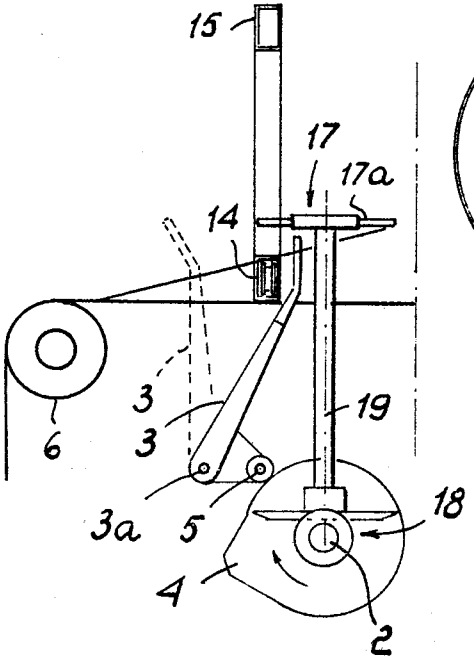
FIG. 1 is a schematical side view of a shuttleless loom according to this invention.

With reference to the drawing figures, the loom has a structure which is for some aspects similar to that of conventional looms. It comprises, as shown in FIGS. 1 and 2, a supporting frame 1; a main shaft 2; a sley 3 which can be induced to oscillate about a lower pivot 3*a* under control of a cam 4 keyed to the main shaft 2 and acting on a cam follower 5 rigid with the sley 3; heddles, not shown; and a roll 6 for redirecting the finished fabric, as produced by weft and warp threads crisscrossing one another.

According to this invention, the shuttleless loom shown includes a unique and particularly advantageous weft thread carrier throwing device. Specifically, with reference to FIGS. 1 to 3, there is provided, in a first embodiment of the invention, a weft thread carrier throwing device, generally indicated at 7, which comprises the elements that will now be described.

A rotary member 8, comprising substantially a wheel or flywheel, rotatably engages a shaft which in this example happens to be horizontal; and which may be rotatively driven by an electric motor. The wheel 8 has a diameter and angular velocity such that a tangential peripheral velocity is attained which is equal to or higher than the desired throwing velocity sought for the weft thread carriers that take the weft thread through the loom shed, i.e. substantially through the warp threads. Around the rotary member or wheel 8, there is provided a fixed casing 9 which is shaped to define, between the wheel 8 and casing 9 itself, an open throwing track 10 the cross section dimensions whereof are similar to the cross section dimensions of the weft thread carriers being employed.

The open throwing track 10, according to the embodiment shown, has a nearly circular pattern which extends, over a shorter length than the circumference of the wheel 8, between an inlet end 11 and an open outlet end 12. More specifically, the open outlet 12 opens, without obstacles or interruptions, into the loom shed insertion region through an inlet channel 12*a* tangent to the wheel 8 and aligned with the path line extending through the warp threads. In this embodiment, the open outlet end 12 is located substantially at the lower end of the wheel 8, whereas the inlet end 11 is located higher up. The direction of rotation of the wheel 8 is naturally from the inlet 11 to the open outlet 12 along the open throwing track 10 as indicated by the arrow in FIGS. 2 and 4.

Substantially adjacent the inlet 11, there is provided according to this invention an accumulator chamber 13 adapted for receiving and withholding the weft thread carriers, indicated at 14, which are to be thrown into the open track 10. The accumulator chamber 13 receives the weft thread carriers 14 from the recovering device, generally indicated at 15. The introduction of the weft thread carriers 14 into the accumulator chamber 13 is carried out through the top of the chamber 13 itself, devices being advantageously provided for damping the fall and movement of the weft thread carriers 14, e.g. devices comprising flexible elastic partitions, indicated at 16 in FIGS. 2 and 4. These partitions 16 are each fixed to a wall of the accumulator chamber 13 and overlap each other such as to elastically close the inlet opening of the accumulator chamber 13. The partitions 16 dampen the velocity of the weft thread carriers 14 as the latter are coming from the recovering device 15 and enter the accumulator chamber 13. Alternatively, and advantageously, there may be provided damping means (FIG. 7) which comprise a braked wheel 21 effective to take up the kinetic energy of the weft thread carriers 14 which are being returned from the shed after having inserted a weft thread between the warp threads. The braked wheel 21 takes up, at its top portion where it contacts the weft thread carriers 14, the impact and the rotational and translational velocity of the weft thread carriers 14 and reduces both the rotational and the translational velocity of the carriers by causing the carriers to assume the rotational velocity of the braked wheel itself owing to frictional engagement ofthe thread carriers 14 with the braked wheel 21 at one side and the opposite fixed surface of a passage 15*a* at the other side. This braking action due to the presence of the braked wheel 21 avoids that the arriving thread carriers 14 reach the accumulator chamber 13 with a too high velocity, which could cause turbulence within the accumulator chamber and irregular arrangement of the weft thread carriers 14 for subsequent feeding to the throwing device. The rotation of the braked wheel 21 may be controlled by means of any frictional brake, such as a shoe or disk brake, of the like, associated, for example, to the shaft or axle 22 of the braked wheel itself.

In a novel manner, the action of the wheel 21 on the arriving weft thread carriers 14 can be adjusted by varying the area of the passage 15*a*, one wall whereof is defined by the wheel itself. To this aim, the shaft or axle 22 of the braked wheel 21 is carried in a slide 23 which is guided by fixed fins 24 in the direction of the arrows 25 in FIG. 7, namely in a direction to more or less throttle the passage 15*a*. Displacement of the slide 23 may occur for instance by means of a worm screw arrangement.

The accumulator chamber 13 tapers towards the bottom such as to convey one by one the weft thread carriers 14 towards the inlet 11 of the open throwing track 10.

Figure 3:
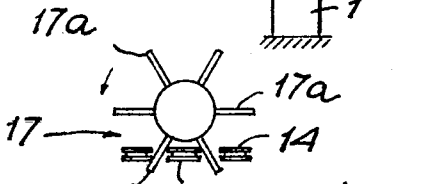
FIG. 3 evidences in plan view a feeder according to one embodiment of this invention.

At the bottom of the accumulator chamber 13, adjacent to the inlet 11, there is provided, according to this invention, a feeder 17 which comprises, according to the embodiment illustrated in FIGS. 1 to 3, a feeding wheel having its axis perpendicular to the rotation axis of the wheel or flywheel 8 and provided with peripheral pegs 17*a* defining a plurality of angular sectors. In FIG. 2, only the termination ends of the pegs 17*a* are shown. The distance between two successive pegs will be directly related to the size of the weft thread carriers being employed, thereby as shown in FIG. 3, permitting only one weft thread carrier 14 to become inserted between two consecutive pegs and be sent, by rotation of the feeding wheel 17, to the inlet 11 and hence to the open throwing track 10.

As evidenced in particular in FIGS. 1 and 2, the feeding wheel 17 is driven by the main shaft 2 through a bevel gear pair 19 and a vertical shaft 18. The bevel gears 19 are so proportioned as to result in a one pitch distance movement of the pegs 17*a* of the feeding wheel 17', per revolution of the main shaft 2. The movement may be either continuous, as shown in the drawings, or intermittent, if desired.

Figure 5:
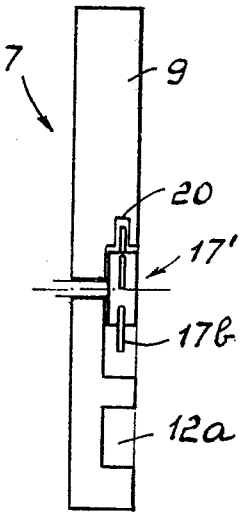
FIG. 5 is a side view of FIG. 4, taken along the section line V—V of FIG. 4.
Figure 4:
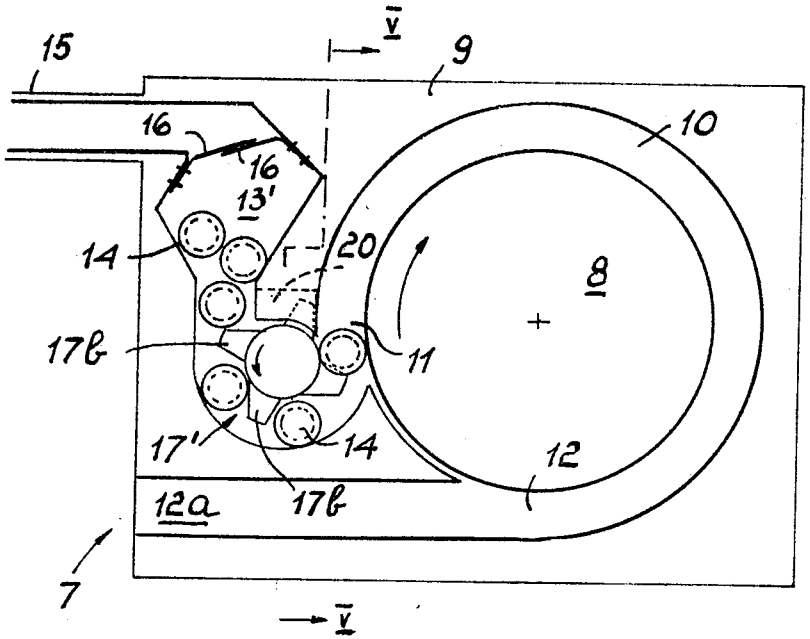
FIG. 4 shows on an enlarged scale with respect to the preceding figures a variation of a portion of the loom of FIG. 2.
Figure 6:
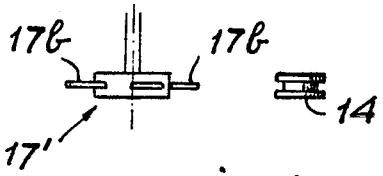
FIG. 6 shows a feeder according to this invention constituting a variation of the feeder of FIG. 3.

FIGS. 4, 5 and 6 illustrate a further embodiment of the feeder. In this second embodiment, a feeding wheel is arranged with its rotation axis parrallel to that of the flywheel 8, and the pegs 17*a* are replaced by teeth 17*b*, between which recesses are defined in which the weft thread carriers 14 will again be inserted for introduction into the open throwing track 10 through the inlet 11. In order to allow the feeding wheel 17' of FIG. 4 to rotate without causing undesired returns of the weft thread carriers 14 to the accumulator chamber 13', there is provided a cutout 20 in the casing 9 for the passage therethrough of the teeth 17*b* returning to the accumulator chamber 13'. It will be appreciated that the feeding wheel 17' of the second embodiment, having a horizontal axis of rotation, is driven synchronously with the rotation of the main shaft 2, as in the first embodiment described hereinabove.

Figures 7, 8, 9:
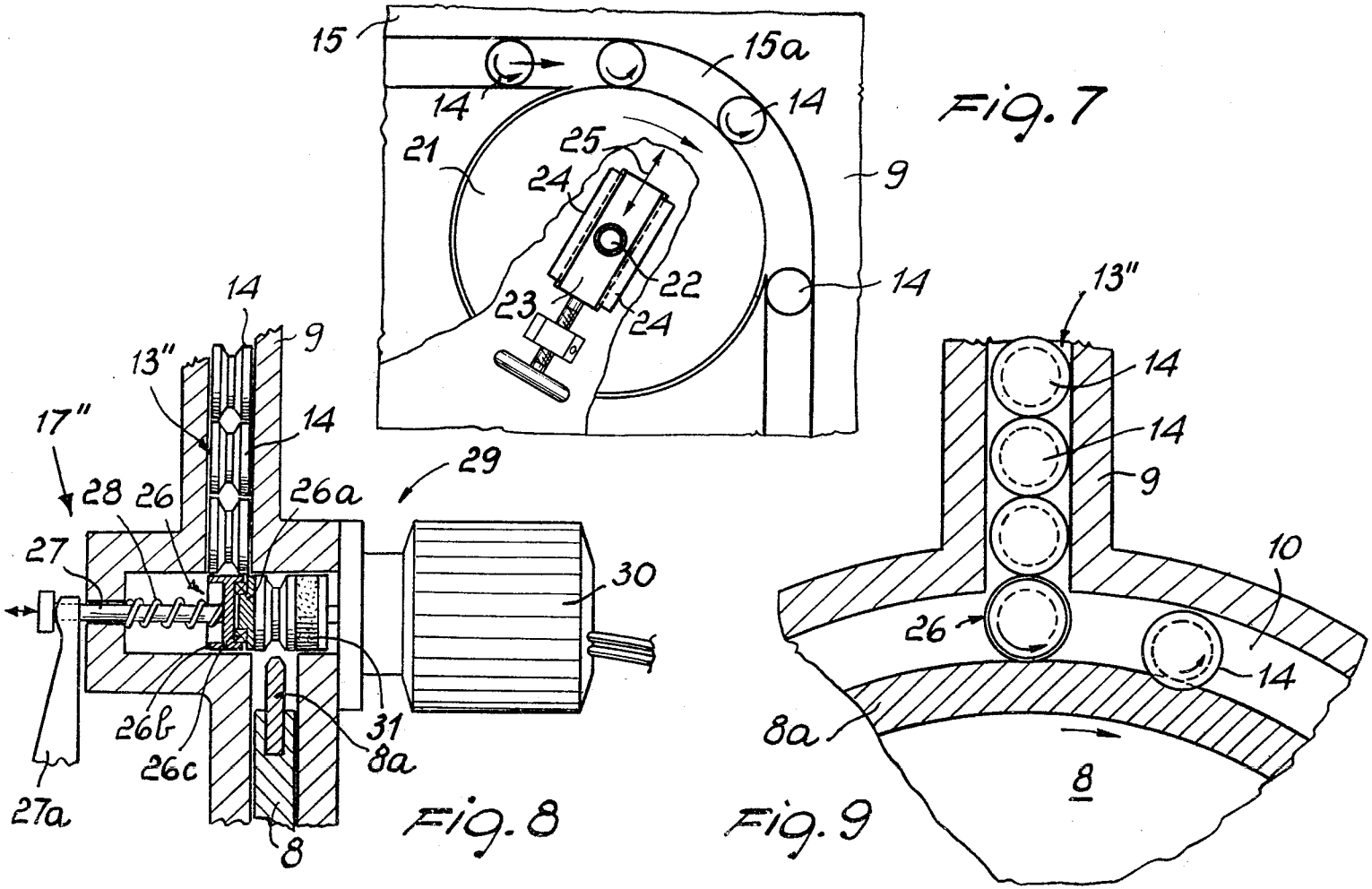
FIG. 7 shows a backing device in a loom according to this invention.
FIGS. 8 and 9 show, in two sectional views perpendicular to each other, a further variation of the feeder of FIG. 3.

FIGS. 8 and 9 illustrate a further advantageous variation of the feeder 17. In this embodiment, at the bottom of an accumulator chamber 13'' substantially configurated as a vertical loader and adjacent the wheel 8 but offset with respect thereto because arranged in a different plane, a feeder 17'' is adapted for shifting the weft thread carriers 14 axially, to take them from the plane of the outlet of the accumulator chamber 13'' to the plane of the wheel 8. More in detail, in FIGS. 8 and 9 a piston 26 and related rod 27 can be observed, which are movable axially in a direction parallel to the axis of the wheel 8. The piston 26 and rod 27 are driven by a lever 27*a* which derives its motion from the main shaft 2 and acts against the bias of a spring 28 tending to bring the piston 26 below the outlet of the accumulator chamber 13''.

Advantageously, opposite the piston 26 and close to the wheel 8, there is provided a pre-rotation device 29 operative to impart to each weft thread carrier 14 a rotation speed close to the one it will acquire upon contacting the wheel or flywheel 8. The device comprises an electric motor 30 which rotates a friction disk 31 secured to the shaft of the motor 30. The disk 31 is located opposite the feeder 17'', and more specifically facing the piston 26. When the latter is urged to its position below the outlet of the accumulator chamber 13'' by the spring 28 a weft thread carrier 14 remains clamped between the friction disk 31 and the piston 26 and thus begins to rotate about its own axis owing to the continuous rotation of the friction disk 31 against which the weft thread carrier 14 is pressed. To prevent the piston 26 from also rotating, which would disturb the accumulation of weft thread carriers 14 in the accumulator chamber 13'', the piston 26 comprises at least two portions: a first or front portion 26*a* of plate-like shape, and a second or rear portion 26*b*, rigid with the rod 27. A bearing 26*c* is interposed between the two portions 26*a* and 26*b*.

Advantageously, as a further aspect of this invention, it is arranged, as shown in the drawing figures that the improved shuttleless loom desribed in the foregoing can accept substantially cylindrical weft thread carriers 14 having a central peripheral groove, which are specially easy to drive and inexpensive and involve reduced losses of kinetic energy during their movements.

Such weft thread carriers and the mode of operation for inserting the weft thread between the warp threads are disclosed in U.S. Pat. No. 4,098,300 issued to the same inventor.

When such weft thread carriers are used, the open throwing track 10 may have a constant cross-section throughout, and the wheel or flywheel 8 may have a regular circular peripheral profile.

In particular, by providing said weft thread carriers 14 shaped as explained, the inlet 11 to the open throwing track 10 may be a simple port tapering slightly towards the track inside, substantially to the diameter dimensions of the carriers 14, which will be inserted with their axis parallel to the axis of the wheel or flywheel 8. For a fast entrainment of the weft thread carriers 14, it will be sufficient that the wheel or flywheel 8 be provided at its periphery with a lining of a high frictional coefficient material, such as rubber.

FIG. 8 shows in particular a rubber ring 8*a*, or ring of a similar material, which becomes inserted in the central peripheral groove of the weft thread carriers 14 as each of the latter is left free by the piston 26 and falls down in engagement with the ring 8*a*. Rotation of the wheel 8 and ring 8*a* causes the weft thread carriers 14 to be entrained by the wheel 8 while continuously rotating about their own axes.

As mentioned, the wheel or flywheel 8 has an angular velocity and a diameter such as to result in a tangential velocity which is equal to or higher than the desired throwing velocity of the weft thread carriers 14. In fact, depending on the type of weft thread carriers employed, on the lining and shape of the wheel or flywheel 8, the weft thread carriers will acquire, along the open throwing track 10 of a strictly preset length, a final velocity which is equal to or lower than the tangential velocity of the wheel. In the event of their exiting at a lower velocity, in order to achieve the desired throwing velocity, it will be sufficient to rotate the wheel 8 at a tangential velocity proportionally higher than the throwing velocity sought.

Advantageously, by providing a throwing device 7 of this invention, it becomes possible, while using an open throwing track 10 of strictly predetermined length, to obtain in practice any throwing velocity; it is in fact possible to vary not only the rotational speed of the wheel or flywheel 8, as explained above, but also the diameter thereof, and accordingly the length of the open throwing track 10, or alternatively to provide the wheel 8 in the shape of a drum and make the weft thread carriers 14 follow an open throwing track 10 of spiral configuration. In that case, it will thus be possible to cause the weft thread carriers 14 to execute several turns about the wheel axis before they are ejected through the outlet 12.

According to this invention, any recovering devices may be utilized for recovering the weft thread carriers 14. Thus, the objective of minimizing as far as possible any alterations of existing loom structures, is accomplished while achieving substantial and fundamental advantages, as explained hereinafter. However, it is an added advantage of the invention that with the throwing device 7 just described there can be associated a recovering device 15 of extreme simplicity and functionality. This recovering device comprises, as shown in FIG. 2, fixed guides which receive the weft thread carriers 14 after they have been passed between the warp threads, and redirect them back to the throwing device 7, and precisely to the accumulator chamber 13, 13' or 13''. The recovering device 15 having fixed guides is particularly effective when used in combination with substantially cylindrical weft thread carriers 14, but could also be employed with other types of weft thread carriers. In all cases, any known conveyor may be utilized, provided that it takes the weft thread carriers back to the accumulator chamber 13, 13' or 13''.

The operation of the improved shuttleless loom according to this invention will be apparent from the foregoing description. Leaving out the operation of the conventional members, because known from the prior art, it will be explained how the weft thread carriers 14 are thrown through the shed.

From the accumulator chamber 13, 13' or 13'', gradually and by gravity, the weft thread carriers 14 are dropped to the bottom of the chamber, and line up until they are engaged by the feeding device 17, 17', or 17'' which inserts them, gradually and one by one, through the inlet end 11 of the open throwing track 10. Upon being inserted through said inlet 11, each weft thread carrier contacts the outer peripheral surface of the wheel or flywheel 8, which is advantageously provided with a high frictional coefficient material 8*a*, and is then entrained along the track 10. The rotational speed of the wheel of flywheel 8 is substantially constant, owing among others to the large mass thereof, but the velocity of the weft thread carriers along the track 10 increases from zero to the desired throwing velocity. However, the acceleration is not instantaneous as with conventional shuttleless looms, wherein an impact is actually applied to accelerate the weft thread carrier. Especially when the pre-rotation device 29 is used, which imparts to each weft thread carrier 14 a rotational velocity proximate to that imparted by the wheel 8, a more uniform acceleration of the weft thread carriers is achieved. Tests have been carried out and very satisfactory results have been achieved with a wheel 8 having a diameter of about 16 inches and a rotational speed of about 3,000 Rpm. The weft thread carriers 14 had a diameter of about 0.7 inches and a throwing speed of about 100 feet/sec.

The feeder 17, 17' or 17'' is coordinated in its operation to the rotation of the main shaft 2 of the loom, which means that for each revolution of the main shaft 2 and accordingly for each complete oscillation of the sley 3 there corresponds the insertion of one weft thread carrier 14 in the open throwing track 10. In order to cause the weft thread carriers to be thrown between the warp threads, dragging a weft thread therealong, at the appropriate time, the feeder 17, 17' or 17'' will introduce the weft thread carriers 14 in the track 10 at an advance with respect to said appropriate throwing time which is equal or directly related to the time lapse required to span the track 10. After inserting the weft thread through the shed, the weft thread carriers 14 are caused to run along the recovering device 15, and after engagement with said damping means 16 or 21, are returned to the accumulator chamber 13, 13' or 13''.

The invention achieves its objects.

In fact, this inventive shuttleless loom consumes far less energy inasmuch as the throwing device operates continuously, thereby no energy need be expended to restart it. In view of the latter consideration, the loss of energy due to the weft thread carriers being halted each time prior to throwing becomes a secondary factor. Anyhow, by providing the recovering device 15 with fixed guides, the kinetic energy of the weft thread carriers is utilized to spontaneously return, without any added devices, the carriers themselves to the accumulator chamber 13.

The loom is also remarkably silent in operation, by virtue of the continuously operated throwing device 7 and because the weft thread carriers are being accelerated gradually rather than almost instantaneously. The surface of the wheel of flywheel 8, which is provided with a high frictional coefficient material, such as rubber, contributes then materially to the noiseless operation of the loom.

But above all, the improved shuttleless loom of this invention is unique in its construction and operation simplicity, which affords an extremely reduced manufacturing cost and cost of adaptation of existing looms. Indeed, the throwing device 7 is very simple in construction and the throwing track is at all times open, while the throw synchronization occurs by inserting one weft thread carrier into the track at the appropriate time.

In practice, a shuttleless loom has been provided which, while stopping the weft thread carriers at each throw, neverthless minimizes the energy waste, by using throwing devices which rotate continuously, and reduce the noise emission level, without introducing any constructional complication. On the contrary, when the loom is constructed for example in the form shown in FIG. 2, it is much simpler than any other shuttleless loom of conventional design.

The invention as described is susceptible to many modifications and variations, all of which are intended to fall within the scope of the instant inventive concept. Moreover, all of the details may be replaced by other technically equivalent elements.

In practicing the invention, the materials and dimensions used may be any ones to suit individual applicational requirements.

I claim:

1. An improved shuttleless loom comprising number of weft thread carriers, a weft thread carrier throwing device and a weft thread carrier recovering device, and means for substantially halting each of said weft thread carriers prior to the throwing thereof, wherein said throwing device comprises a rotary member and a fixed casing defining an open throwing track for said weft thread carriers, said throwing track having an inlet and an outlet end and said outlet end being open towards a loom shed, and wherein said means for substantially halting said weft thread carriers comprise an accumulator chamber located substantially adjacent to said inlet end for withholding each of said weft thread carriers supplied by said recovering device, a feeder located between said accumulator chamber and said inlet end of said open throwing track for inserting said weft thread carriers one by one from said chamber into said track, and means for actuating said feeder in synchronism with a sley of the loom such that each weft thread carrier is inserted into said open throwing track in advance with respect to the time of insertion of said weft thread carrier through the loom shed by an amount dependent on the time period requird to span said open throwing track.

2. A shuttleless loom according to claim 1, wherein said feeder comprises a feeding wheel having peripheral pegs for engaging and guiding therebetween said weft thread carriers, said feeding wheel having a rotation axis perpendicular to the rotation axis of said rotary member, said feeding wheel being rotatively driven by a main shaft of the loom, said main shaft being also controlling oscillations of said sley.

3. A shuttleless loom according to claim 1, wherein said feeder comprises a feeding wheel having peripheral teeth defining recesses therebetween for receiving and guiding said weft thread carriers, said feeding wheel having an axis substantially parallel to the rotation axis of said rotary member and being driven to rotate by a main shaft of the loom.

4. A shuttleless loom according to claim 1, further comprising a main shaft, wherein said feeder comprises an axially movable piston and a lever actuated by said main shaft for displacing said piston from a position below a lower outlet of said accumulator chamber and proximate to said rotary member to a position farther apart from said rotary member and away from said lower outlet of said accumulator chamber, said piston axially feeding at each forward step towards said rotary member one of said weft thread carriers after picking it up from below said lower outlet of said accumulator chamber.

5. A shuttleless loom according to claim 4, wherein said feeder further comprises a pre-rotation device cooperating with said piston when said piston is in said position proximate to said rotary member, for imparting to each of said weft thread carriers a rotational speed about its own axis, close to the one imparted to said weft thread carriers by said rotary member in said throwing track.

6. A shuttleless loom according to claim 1, wherein said feeder is arranged at the bottom of said accumulator chamber and said weft thread carriers are supplied to said feeder by gravity.

7. A shuttleless loom according to claim 1, wherein said rotary member comprises a coated wheel having a peripheral lining made of a high frictional coefficient material, said lining being arranged at the area of contact with said weft thread carriers.

8. A shuttleless loom according to claim 1, further comprising means for damping the kinetic energy of said weft thread carriers between said recovering device and said accumulator chamber, said damping means comprising a braked wheel having a peripheral portion defining one wall of a passage for said weft thread carriers.

9. A shuttleless loom according to claim 8, further comprising means for adjusting said braked wheel in a direction perpendicular to its axis of rotation such as to vary the area of said passage.

* * * * *